United States Patent [19]

Nagler

[11] Patent Number: 4,866,786

[45] Date of Patent: Sep. 12, 1989

[54] OVENABLE BAG

[75] Inventor: Peter M. Nagler, Baldwin, N.Y.

[73] Assignee: Sentinel Bag & Paper Company, Inc., Brooklyn, N.Y.

[21] Appl. No.: 182,852

[22] Filed: Apr. 18, 1988

[51] Int. Cl.[4] ..... B65D 30/02; B65D 30/12; B65D 30/22; B65D 33/01

[52] U.S. Cl. ..... 383/101; 383/103; 383/114; 426/107; 426/113; 426/118; 493/243; 493/244

[58] Field of Search ..... 383/103, 120, 123, 114, 383/115, 45, 101; 493/243, 244; 229/DIG. 14; 426/107, 113, 118

[56] References Cited

U.S. PATENT DOCUMENTS

| | | | |
|---|---|---|---|
| 143,321 | 9/1873 | Benner . | |
| 221,700 | 11/1879 | Pettee | 493/243 |
| 421,191 | 2/1980 | Porter | 383/123 |
| 1,619,177 | 3/1927 | Avery | 383/123 |
| 1,887,680 | 11/1932 | Hallman . | |
| 2,054,298 | 9/1936 | Poppe . | |
| 2,312,280 | 2/1943 | Avery | 383/114 |
| 2,429,505 | 10/1947 | Ashman | 383/123 |
| 2,516,978 | 8/1950 | Gottesman . | |
| 2,593,328 | 4/1952 | Meaker | 383/103 |
| 2,730,295 | 1/1956 | Bokenkroger | 383/123 |
| 2,735,215 | 2/1956 | Rutledge | 383/123 |
| 2,929,544 | 3/1960 | Herschler . | |
| 3,035,754 | 5/1962 | Meister | 383/120 |
| 3,066,847 | 12/1962 | Fortune | 383/113 |
| 3,107,989 | 10/1963 | Fesco | 383/120 |
| 3,227,359 | 1/1966 | Hanlon . | |
| 3,248,041 | 4/1966 | Burke | 229/DIG. 14 |
| 3,285,498 | 11/1966 | Becker | 383/123 |
| 3,363,750 | 1/1968 | Smith . | |
| 3,457,707 | 7/1969 | Fesco . | |
| 3,507,443 | 4/1970 | Gerard | 383/103 |
| 3,526,354 | 9/1970 | Gibbs | 383/123 |
| 3,565,328 | 2/1971 | Hudson | 383/114 |
| 3,775,239 | 11/1973 | Snow . | |
| 4,026,460 | 5/1977 | May | 229/DIG. 14 |
| 4,450,180 | 5/1984 | Watkins . | |
| 4,672,684 | 6/1987 | Barnes et al. | 383/45 |

FOREIGN PATENT DOCUMENTS 565770 12/1932 Fed. Rep. of Germany .

*Primary Examiner*—Stephen P. Garbe

*Attorney, Agent, or Firm*—Cobrin, Feingertz & Gittes

[57] ABSTRACT

An ovenable bag includes a sheet of paper-like material; opposite edges of the sheet secured to each other to define a tubular member having opposite ends; the tubular member being folded inwardly along lengthwise fold lines thereof which are diagonally offset from each other and being flattened with respect to the lengthwise fold lines to form two pair of lengthwise crease lines that are parallel to the lengthwise fold lines, such that the flattened tubular member is defined by a wide wall section, a narrow wall section and an expandable wall section connecting the wide and narrow wall sections together; the narrow wall section extending past the wide wall section in the lengthwise direction of the flattened tubular member at a first end thereof; the flattened tubular member being folded over itself at the first end thereof along a transverse fold line; the wide wall section being adhered to itself at the folded first end of the flattened tubular member; and the narrow wall section being adhered to the expandable wall section and the wide wall section at the folded first end of the flattened tubular member to provide a liquid seal at the folded first end of the flattened tubular member.

8 Claims, 6 Drawing Sheets

FIG. 1
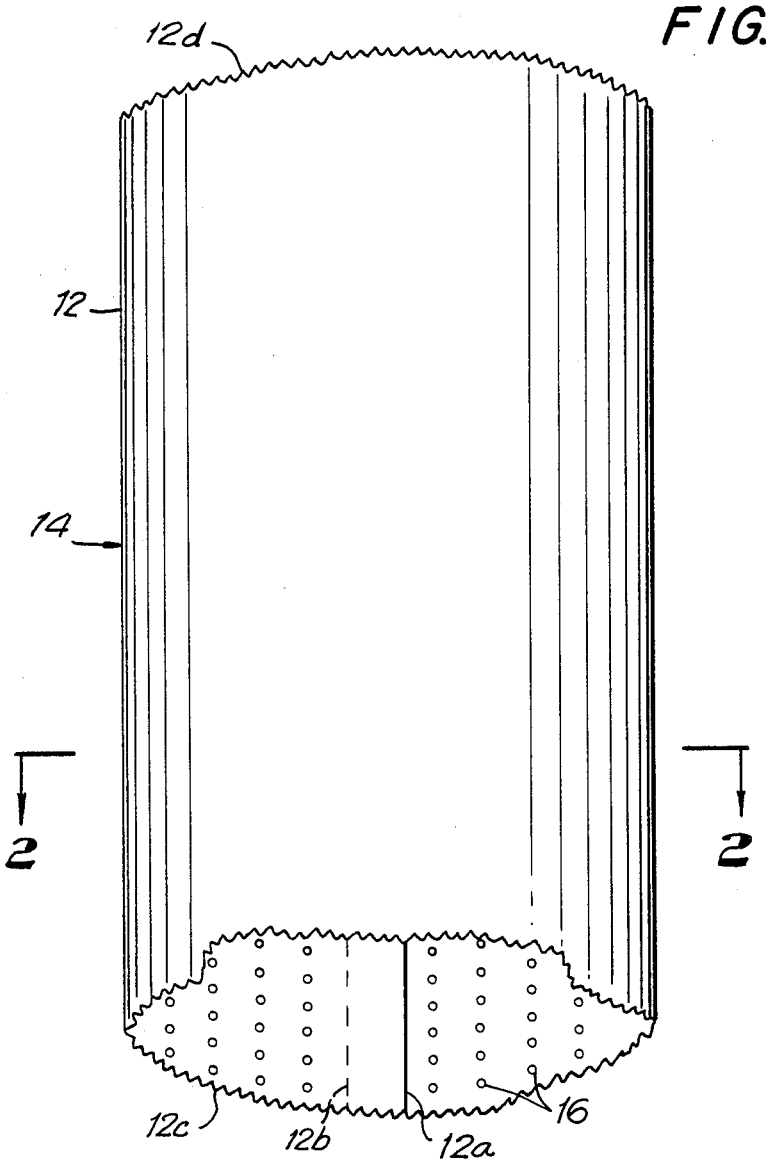
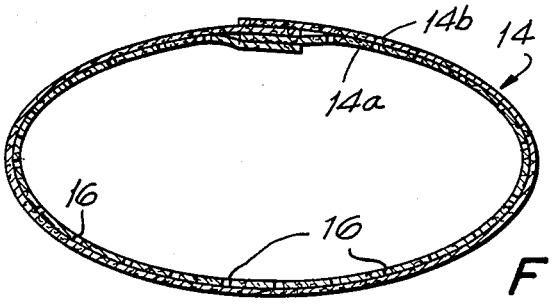
FIG. 2

OVENABLE BAG

BACKGROUND OF THE INVENTION

This invention relates generally to paper-like bags, and more particularly, is directed to a paper-like bag that can be used in an oven and microwave for cooking different foods.

Generally, when foods are prepared in an oven or microwave, they must be removed from their containers and placed on a tray, plate or the like for cooking. More recently, plate and bowl-like containers for both containing and cooking foods have been introduced. In such case, the food need not be removed from the container. However, such containers are generally rigid so as to prevent leakage, and are relatively expensive to manufacture.

It has been known to hold foods in paper-like bags. However, such bags are not designed to be used in a conventional or microwave oven for cooking foods that produce liquids, such as fats, when cooked. Even if such bags could be used in a microwave or conventional oven, there is still the problem of leakage from the bag once the food is heated.

Various paper bags and the like for holding foods and other articles are known from U.S. Pat. Nos. 143,321; 1,887,680; 2,054,298; 2,516,978; 2,929,544; 3,227,359; 3,363,750; 3,457,707; 3,775,239; and 4,450,180.

U.S. Pat. No. 1,887,680 discloses the folding and creasing of a bag. See also U.S. Pat. Nos. 2,929,544; 3,227,359. U.S. Pat. No. 3,363,750 discloses a package and drinking container in which the sides of the container are formed with offset fold lines extending along the length thereof. See also U.S. Pat. No. 3,457,707.

U.S. Pat. No. 3,775,239 discloses a sealable packaging material, and the entire disclosure of this patent is incorporated herein by reference.

OBJECTS AND SUMMARY OF THE INVENTION

Accordingly, it is an object of the present invention to provide an ovenable bag that overcomes the aforementioned problems with the prior art.

It is another object of the present invention to provide an ovenable bag that can be used to contain a food item at the point of sale, and can also be used for cooking the food item in a conventional and microwave oven.

It is still another object of the present invention to provide an ovenable bag that provides a double seal at one end thereof.

It is yet another object of the present invention to provide an doubled ovenable bag in which the inner layer is provided with a plurality of pin holes to permit expanding gases and steam to escape from the inside of the bag while cooking.

It is a further object of the present invention to provide an ovenable bag that is inexpensive to manufacture and use.

In accordance with an aspect of the present invention, an ovenable bag includes a sheet of paper-like material; opposite edges of the sheet secured to each other to define a tubular member having opposite ends; the tubular member being folded inwardly along lengthwise fold lines thereof which are diagonally offset from each other and being flattened with respect to the lengthwise fold lines to form two pair of lengthwise crease lines that are parallel to the lengthwise fold lines, such that the flattened tubular member is defined by a wide wall section, a narrow wall section and an expandable wall section connecting the wide and narrow wall sections together; the narrow wall section extending past the wide wall section in the lengthwise direction of the flattened tubular member at a first end thereof; the flattened tubular member being folded over itself at the first end thereof along a transverse fold line; the wide wall section being adhered to itself at the folded first end of the flattened tubular member; and the narrow wall section being adhered to the expandable wall section and the wide wall section at the folded first end of the flattened tubular member to provide a liquid seal at the folded first end of the flattened tubular member.

In accordance with another aspect of the present invention, a method of forming an ovenable bag, includes the steps of forming a substantially rectangular sheet of paper-like material; securing opposite lengthwise edges of the substantially rectangular sheet together to form a tubular member open at opposite ends thereof; folding the tubular member inwardly along lengthwise fold lines thereof which are diagonally offset from each other; flattening the tubular member with respect to the lengthwise fold lines to form two pair of lengthwise crease lines that are parallel to the diagonally offset fold lines, so as to define the flattened tubular member by a wide wall section, a narrow wall section and an expandable wall section connecting the wide and narrow wall sections together; forming a first end of the flattened tubular member such that the narrow wall section extends past the wide wall section in the lengthwise direction of the flattened tubular member at one end thereof; folding the flattened tubular member over itself at the first folded end thereof along a transverse fold line; adhering a portion of the wide wall section that has been folded along the transverse fold line to itself at the first folded end of the flattened tubular member; and adhering a portion of the narrow wall section that has been folded along the transverse fold line to the expandable wall section and the wide wall section to provide a liquid seal at the first folded end of the flattened tubular member.

The above and other objects, features and advantages of the present invention will become readily apparent from the following detailed description which is to be read in connection with the accompanying drawings.

BRIEF DESCRIPTION OF THE DRAWINGS

FIG. 1 is a perspective view of a sheet of material in tubular form which is used to make the ovenable bag according to the present invention;

FIG. 2 is a cross-sectional view of the tubular sheet of FIG. 1, taken along line 2—2 thereof;

DETAILED DESCRIPTION OF A PREFERRED EMBODIMENT

Figure 3:
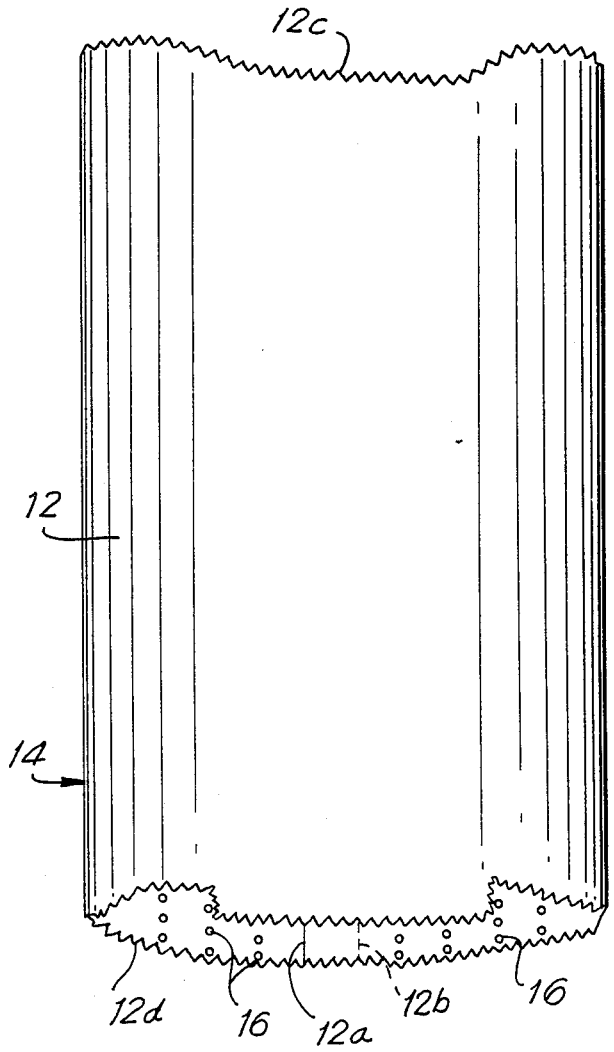
FIG. 3 is a perspective view of the sheet of material of FIG. 1, viewed from the opposite end thereof.

Referring to the drawings in detail, and initially to FIG. 1 thereof, an ovenable bag 10 (FIG. 9) according to the present invention is made from a substantially rectangular sheet 12 of paper-like material having its opposite lengthwise edges 12*a* and 12*b* secured together by an adhesive (not shown) so as to form sheet 12 into a tubular sheet 14, as shown, with opposite ends 12*c* and 12*d* thereof being open. Preferably, tubular sheet 14 is made from two layers 14*a* and 14*b*, as shown in FIG. 2, with the inner layer 14*a* and the outer layer 14*b* being made from a parchment-like material. In such case, inner and outer layers 14*a* and 14*b* are not adhered to each other, or at most, are adhered at only a few distinct points, so that air can flow between the two layers 14*a* and 14*b*. Specifically, inner layer 14*a* is provided with a plurality of pin holes 16, preferably extending along the length thereof. As such, when the food within ovenable bag 10 is cooking, steam and heated gases can escape from bag 10 through pin holes 16 and between layers 14*a* and 14*b*. It is therefore clear that outer layer 14*b* is free of any holes therein, as shown in the drawings.

Figure 5:
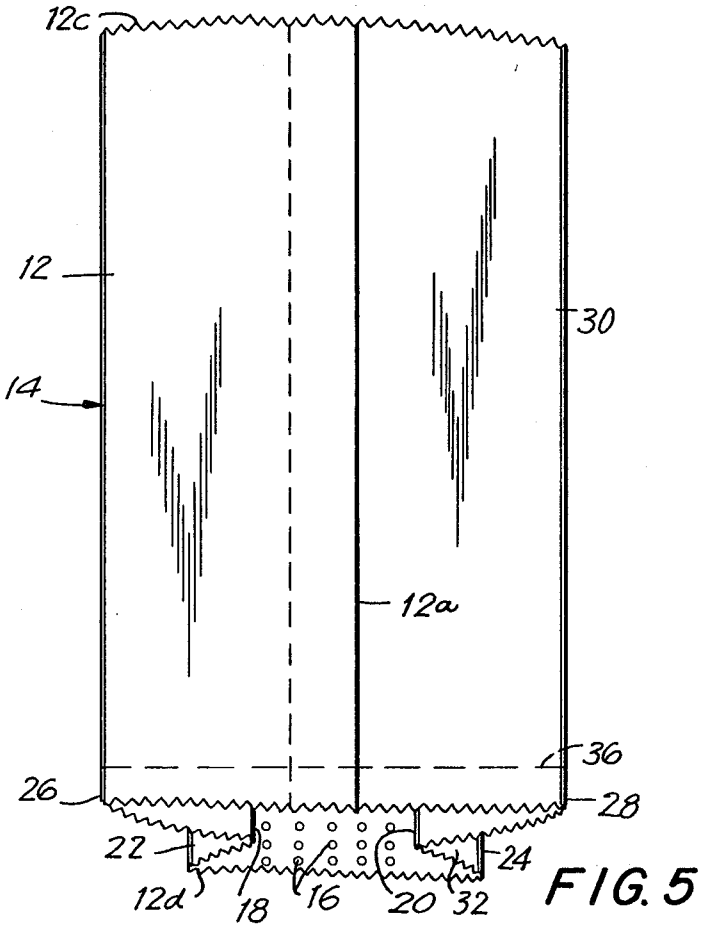
FIG. 5 is a perspective view of the folded tubular sheet of FIG. 4, viewed from the opposite end thereof and inverted 180 degrees.
Figure 4:
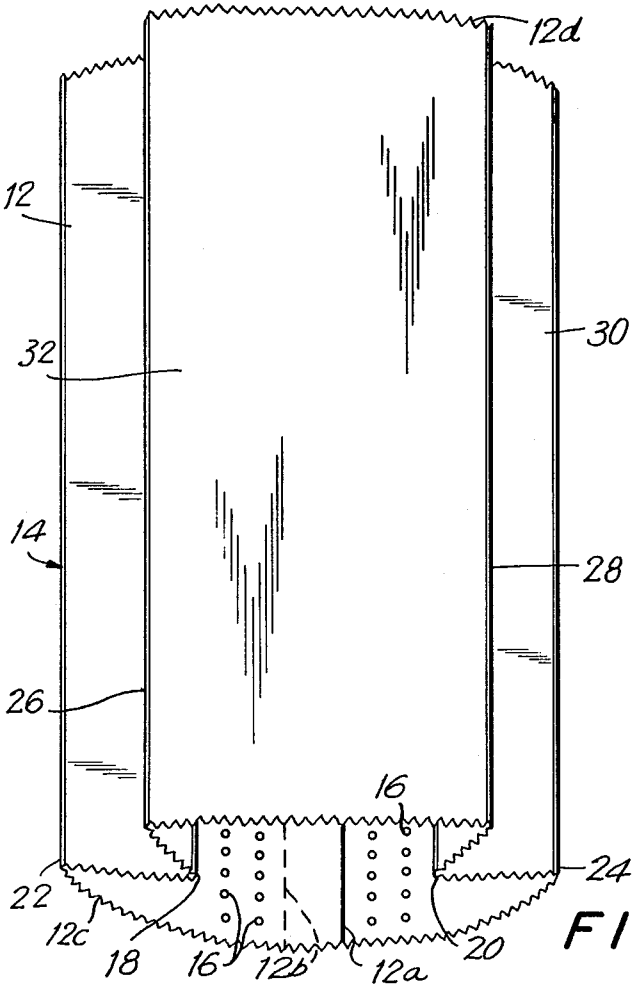
FIG. 4 is a perspective view of the tubular sheet of FIG. 1, folded along diagonally offset lengthwise fold lines and lengthwise crease lines thereof.
Figure 6:
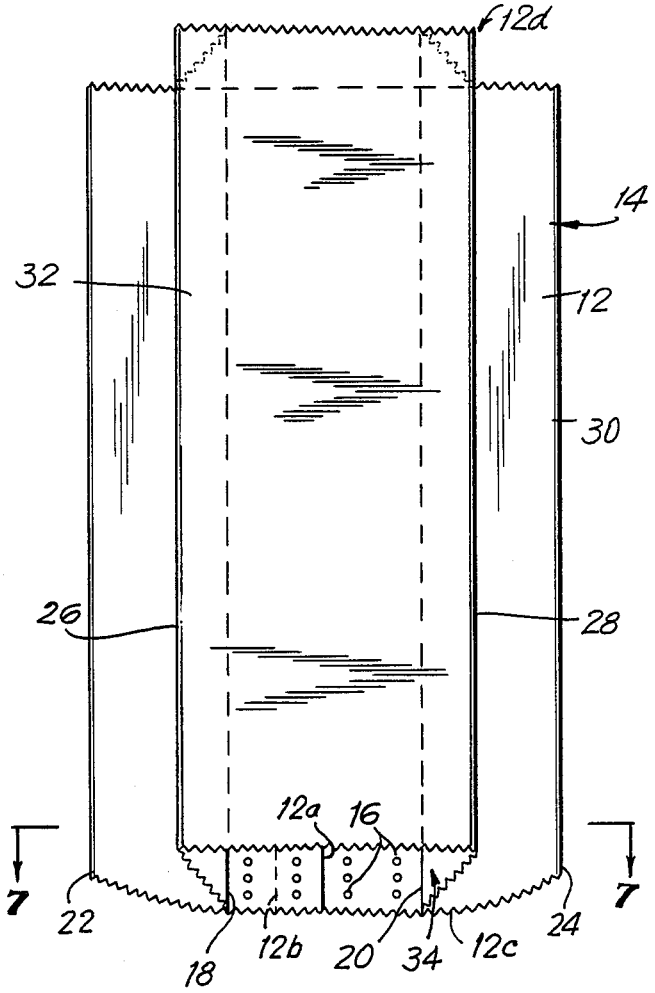
FIG. 6 is plan view of the folded tubular sheet of FIG. 4 when the same is flattened.
Figure 7:
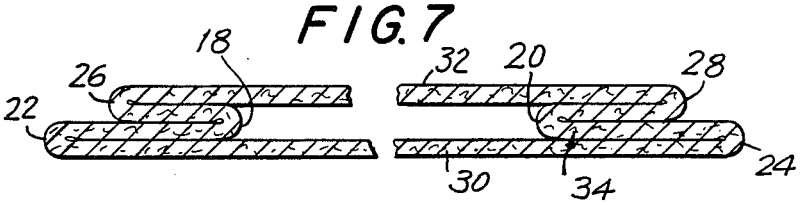
FIG. 7 is a cross-sectional view of the flattened tubular sheet of FIG. 6, taken along line 7—7 thereof.
Figure 8:
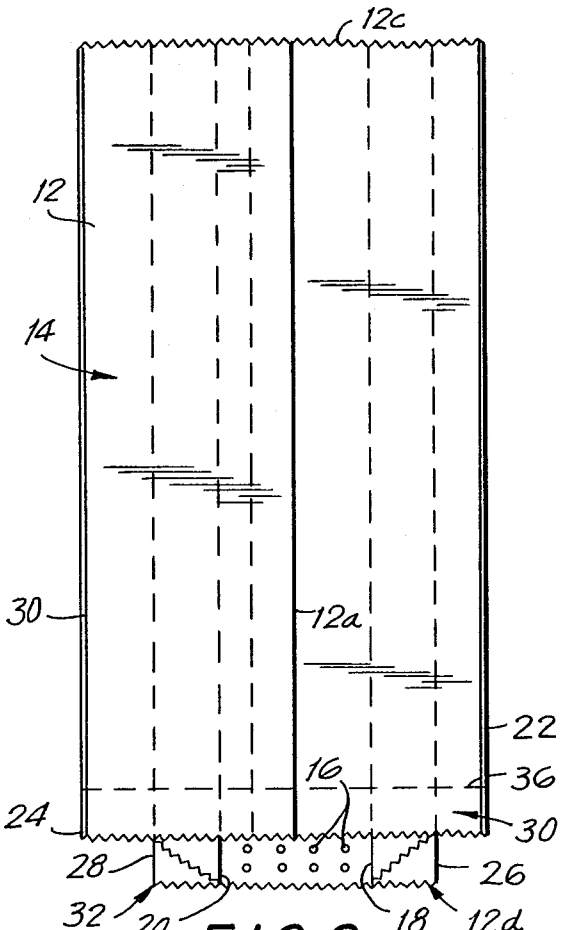
FIG. 8 is plan view of the folded tubular sheet of FIG. 5 when the same is flattened.

Tubular sheet 14 is folded inwardly along lengthwise fold lines 18 and 20 thereof which are diagonally offset from each other and is then folded outwardly about a first pair of lengthwise crease lines 22 and 24 that are parallel to lengthwise fold lines 18 and 20 and equally spaced therefrom, as shown in FIGS. 4 and 5. Tubular sheet 14 is further folded outwardly about a second pair of lengthwise crease lines 26 and 28 that are parallel to lengthwise fold lines 18 and 20 and equally spaced therefrom. Then, tubular sheet 14 is flattened with respect to fold lines 18 and 20 and crease lines 22, 24, 26 and 28, as shown in FIGS. 6 and 8. In this manner, flattened tubular member 14 is defined by a wide planar wall section 30, a narrow planar wall section 32 and an expandable wall section 34 connecting wide and narrow wall sections 30 and 32 together. Basically, fold lines 18 and 20 and crease lines 22, 24, 26 and 28 permit such expandability, whereby wide and narrow wall sections 30 and 32 can be brought toward and away from each other.

In accordance with the present invention, as best seen in FIG. 6, wide wall section 30 extends past narrow wall section 32 in the lengthwise direction of tubular sheet 14 at open end 12*c* thereof. This permits easy loading of food items into ovenable bag 10. This is accomplished by cutting rectangular sheet 12 or tubular sheet 14 either prior to or after folding tubular sheet 14 about fold lines 18 and 20 and crease lines 22, 24, 26 and 28.

At the opposite end 12*d* of tubular member 14, narrow wall section 32 extends past wide wall section 30 in the lengthwise direction of tubular sheet 14, as best seen in FIGS. 6 and 8. This is important to provide a double seal at this end, as will be described in greater detail hereinafter.

Figure 9:
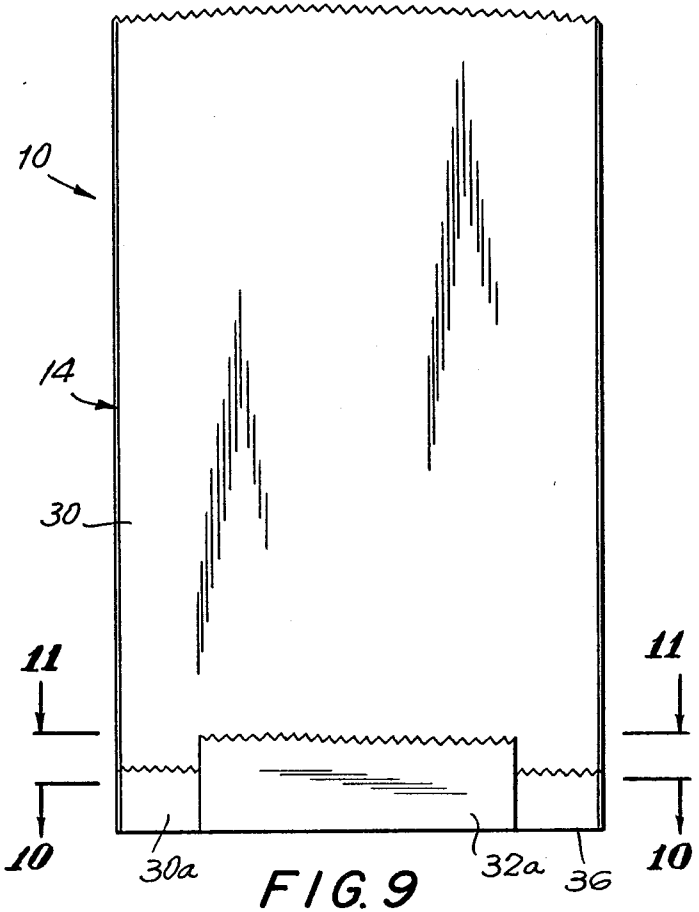
FIG. 9 is a plan view of the flattened tubular sheet of FIG. 8, folded and glued at one end thereof to form the ovenable bag according to the present invention.
Figure 10:
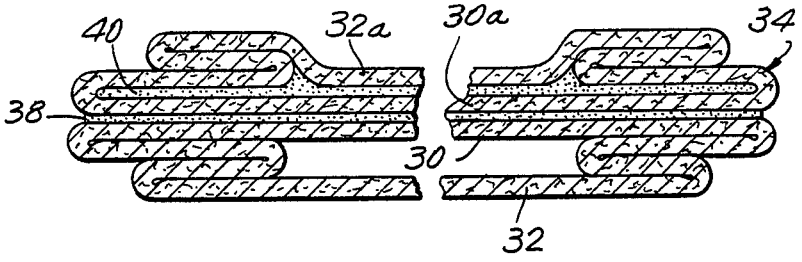
FIG. 10 is a cross-sectional view of the ovenable bag of FIG. 9, taken along line 10—10 thereof.
Figure 11:
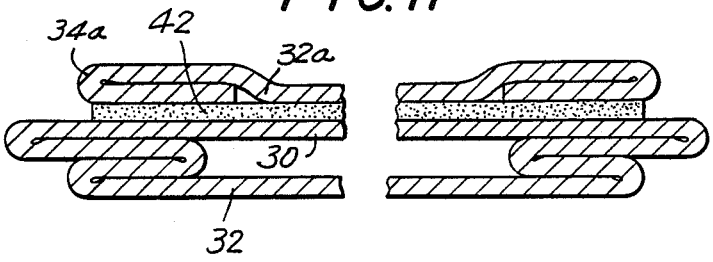
FIG. 11 is a cross-sectional view of the ovenable bag of FIG. 9, taken along line 11—11 thereof.

Then, flattened tubular member 14 is folded over itself at end 12*d* thereof, along transverse fold line 36, such that wide wall section 30 is folded onto itself, as best shown in FIGS. 9 and 10. Specifically, the inner and outer surfaces of the folded portion 30*a* of wide wall section 30 have an adhesive applied thereto, as indicated by adhesive layers 38 and 40 in FIG. 10. As such, layer 38 maintains portion 30*a* in its folded position and layer 40 provides a first seal for ovenable bag 10. As shown in FIG. 10, adhesive layer 40 adheres a folded portion 34*a* of expandable wall section 34 to the folded portion 30*a* of wide wall section 30 and also adheres a center folded portion 32*a* of narrow wall section 32 that is between portion 34*a* to the folded portion 30*a* of wide wall section 30. Then, the inner surface of the folded portion 32*a* of narrow wall section 32 that extends above portion 30*a* of wide wall section 30, has an adhesive layer 42 applied thereto so as to adhere the same to a non-folded portion of wide wall section 30, as shown in FIG. 11. Accordingly, a double seal is provided for bag 10. This double seal is essential to the present invention, since it prevents liquids, such as fats, from escaping from bag 10 during cooking of foods therein. It will be appreciated that this double seal is obtained due to the fact that narrow wall section 32 extends past wide wall section 30 in the lengthwise direction of tubular sheet 14 at the folded end of tubular sheet 14.

Further, because of the two ply construction, that is, because of layers 14*a* and 14*b*, an air pocket is formed between layers 14*a* and 14*b* which functions as an insulation layer to keep any food, such as chicken or the like, that has been cooked in bag 10, warm after the bag has been removed from the oven. Such air pocket is particularly pronounced at the bottom of the bag.

Having described a specific preferred embodiment of the invention with reference to the accompanying drawings, it will be appreciated that the present invention is not limited to that precise embodiment, and that various changes and modifications may be effected therein by one of ordinary skill in the art without departing from the scope or spirit of the invention as defined in the appended claims.

What is claimed is:

1. An ovenable bag comprising:

a sheet of paper-like material made from inner and outer superposed layers of a paper-like material, said inner layer including a plurality of small holes therein to permit escape of heated gases during a cooking operation and said outer layer being free of any holes therein;

opposite edges of said sheet secured to each other to define a tubular member having opposite ends;

said tubular member being folded inwardly along lengthwise fold lines thereof and being flattened with respect to said lengthwise fold lines to form two pair of lengthwise crease lines that are parallel to said lengthwise fold lines, such that said flattened tubular member is defined by a wide wall section, a narrow wall section and an expandable wall section connecting said wide and narrow wall sections together;

said narrow wall section extending past said wide wall section in the lengthwise direction of said flattened tubular member at a first end thereof;

said flattened tubular member being folded over itself at said first end thereof along a transverse fold line;

said wide wall section being adhered to itself at said folded first end of said flattened tubular member; and said narrow wall section being adhered to said expandable wall section and said wide wall section at said folded first end of said flattened tubular member to provide a liquid seal at said folded first end of said flattened tubular member.

2. A bag according to claim 1; wherein said expandable wall section that has been folded along said transverse fold line is adhered to said wide wall section that has been folded along said transverse fold line, a first portion of said narrow wall section that has been folded along said transverse fold line is adhered to a portion of said wide wall section that has been folded along said transverse fold line and a second portion of said narrow wall section that has been folded along said transverse fold line is adhered to a portion of said wide wall section that has not been folded along said transverse fold line so as to provide a double seal at said folded first end.

3. A bag according to claim 1; wherein said inner layer and said outer layer are made from a parchment-like material.

4. A bag according to claim 1; wherein said said wide wall section extends past said narrow wall section in the lengthwise direction of said flattened tubular member at a second end thereof that is opposite said first end.

5. A method of forming an ovenable bag, comprising the steps of:

providing an inner layer of paper-like material having a plurality of small holes therein;

providing an outer layer of paper-like material having no holes therein;

forming a substantially rectangular sheet of paper-like material made from said inner and outer layers superposed on each other so as to permit escape of heated gases during a cooking operation through said small holes and from between said inner and outer layers;

securing opposite lengthwise edges of said substantially rectangular sheet together to form a tubular member open at opposite ends thereof;

folding said tubular member inwardly along lengthwise fold lines thereof;

flattening said tubular member with respect to said lengthwise fold lines to form two pair of lengthwise crease lines that are parallel to said lengthwise fold lines, so as to define said flattened tubular member by a wide wall section, a narrow wall section and an expandable wall section connecting said wide and narrow wall sections together;

forming a first end of said flattened tubular member such that said narrow wall section extends past said wide wall section in the lengthwise direction of said flattened tubular member at one end thereof;

folding said flattened tubular member over itself at said first folded end thereof along a transverse fold line;

adhering a portion of said wide wall section that has been folded along said transverse fold line to itself at said first folded end of said flattened tubular member; and adhering a portion of said narrow wall section that has been folded along said transverse fold line to said expandable wall section and said wide wall section to provide a liquid seal at said first folded end of said flattened tubular member.

6. A method according to claim 5; further including the step of adhering said expandable wall section that has been folded along said transverse fold line to said wide wall section that has been folded along said transverse fold line; and wherein said step of adhering a portion of said narrow wall section includes the steps of adhering a first portion of said narrow wall section that has been folded along said transverse fold line to a portion of said wide wall section that has been folded along said transverse fold line and adhering a second portion of said narrow wall section that has been folded along said transverse fold line to a portion of said wide wall section that has not been folded along said transverse fold line so as to provide a double seal at said folded end.

7. A method according to claim 5; further including the step of forming said inner layer and said outer layer from a parchment-like material.

8. A bag according to claim 5; further including the step of forming a second end of said tubular member that is opposite to said first end such that said wide wall section extends past said narrow wall section in the lengthwise direction of said flattened tubular member.

* * * * *